United States Patent [19]

Steigerwald

[11] 4,047,138

[45] Sept. 6, 1977

[54] POWER INDUCTOR AND TRANSFORMER WITH LOW ACOUSTIC NOISE AIR GAP

[75] Inventor: Robert L. Steigerwald, Scotia, N.Y.

[73] Assignee: General Electric Company, Schenectady, N.Y.

[21] Appl. No.: 688,010

[22] Filed: May 19, 1976

[51] Int. Cl.[2] ..... H01F 27/24

[52] U.S. Cl. ..... 336/100; 336/178; 336/212

[58] Field of Search ..... 336/178, 212, 134, 165, 336/100, 83; 310/192

[56] References Cited

U.S. PATENT DOCUMENTS

| | | | |
|---|---|---|---|
| 416,762 | 12/1889 | Thomson | 336/178 X |
| 1,699,506 | 1/1929 | Faus | 336/134 |
| 2,030,648 | 2/1936 | Meissner | 336/178 X |
| 2,500,748 | 3/1950 | Grant | 336/178 X |
| 2,513,160 | 6/1950 | Friend | 336/134 X |
| 2,722,664 | 11/1955 | Duncan et al. | 336/83 X |
| 3,187,208 | 6/1965 | Van de Graaff | 336/178 X |
| 3,209,295 | 9/1965 | Baermann | 336/165 X |

FOREIGN PATENT DOCUMENTS

| | | | |
|---|---|---|---|
| 67,907 | 6/1944 | Norway | 336/178 |
| 241,300 | 6/1946 | Switzerland | 336/178 |

*Primary Examiner*—Thomas J. Kozma

*Attorney, Agent, or Firm*—Donald R. Campbell; Joseph T. Cohen; Jerome C. Squillaro

[57] ABSTRACT

A ferrite magnetic core includes a one-piece rectangular outer member with aligned circular apertures in which the ends of a cylindrical center member are retained to thus establish a radial air gap. Radial magnetic forces acting on the core members are summed to zero to theoretically eliminate movement and result in low acoustic noise in high operating frequency power inductors and transformers. A magnetic bridge is added to reduce air gap fringing flux outside the core. Other modifications and a "C" core configuration are described.

2 Claims, 14 Drawing Figures

Fig. 8
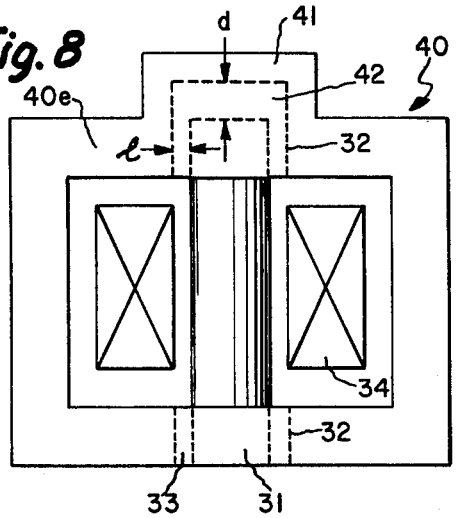
Fig. 9
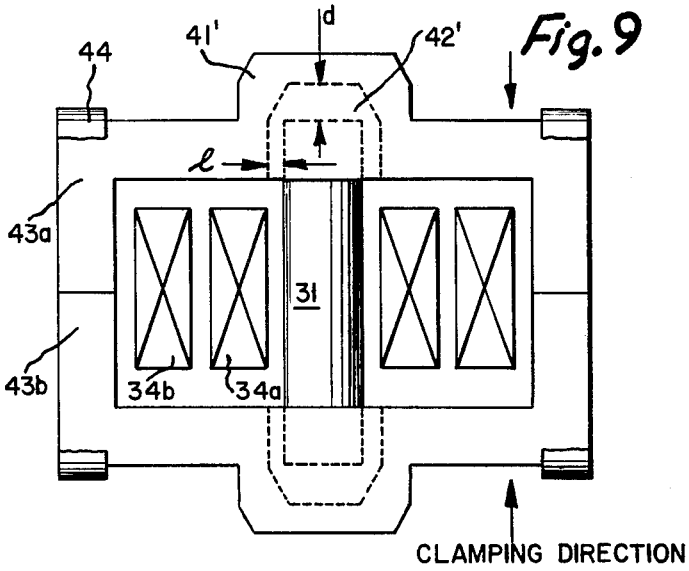
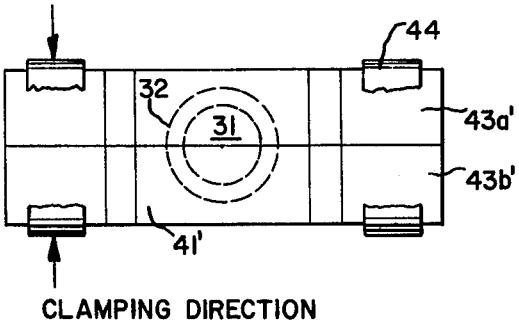
Fig. 10
Fig. 11
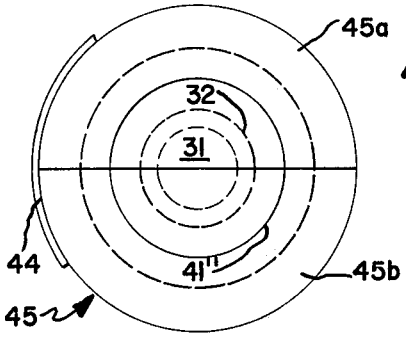
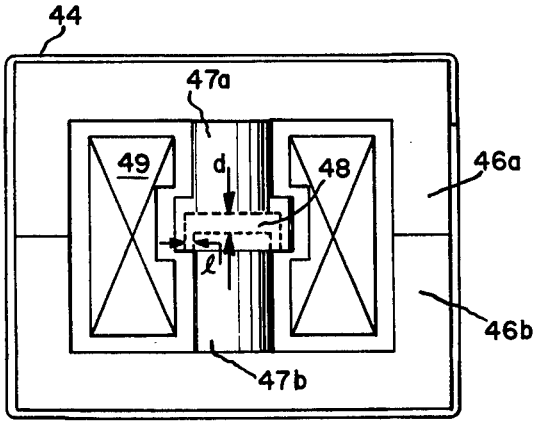
Fig. 12
Fig. 13
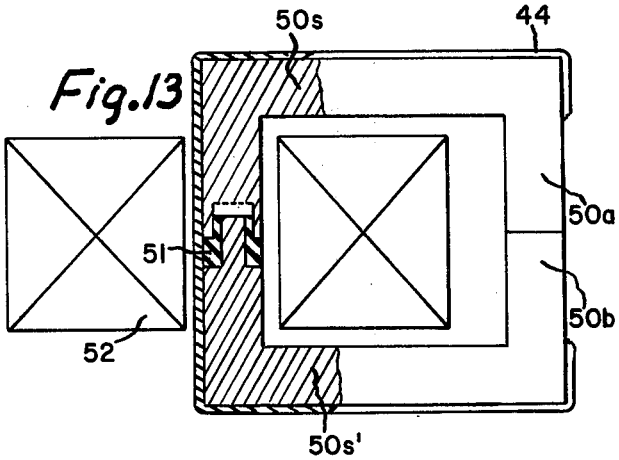
Fig. 14
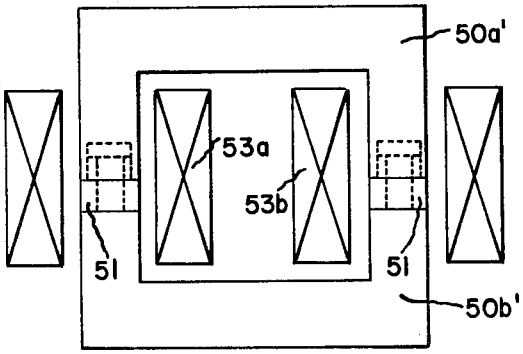

POWER INDUCTOR AND TRANSFORMER WITH LOW ACOUSTIC NOISE AIR GAP

BACKGROUND OF THE INVENTION

This invention relates to power inductors and transformers, and more particularly to high frequency power inductive devices including a ferrite magnetic core structure with an improved air gap arrangement to result in low acoustic noise and reduced fringing flux.

Air gaps are needed in many power magnetics to reduce the permeability to prevent saturation of the core due to dc components of current or, as in inductors, due to high values of alternating current. Conventional three-legged and two-legged magnetic cores such as are shown in FIGS. 1 and 2 are made in two parts, and the air gap is established in series between the two halves of each winding leg extending in the direction of the length of the winding leg. Due to the magnetic field across the air gap, forces exist which tend to periodically shorten the air gap. Thus, movement and flexing of the two parts, especially at high flux levels, in many cases produces a considerable amount of acoustic noise. Additionally, fringing flux from the air gap causes eddy current heating of the windings in its vicinity as well as heating of any metallic bands used to clamp the core parts together. These problems are accentuated at high frequencies of about 5–20 kHz, and it may be necessary to employ nylon tape or plastic fixtures with nylon bolts to clamp the core parts.

Magnetic material with low permeability has also been used in the fabrication of core structures so that no large air gaps need exist. These materials are made by diluting conventional magnetic material with a binder which results in essentially a continuous or distributed air gap. However, these cores are always larger than cores with conventional air gaps due to the diluted nature of the magnetic material. That is, for a given flux level the diluted material requires a larger area than conventional material if the flux density is to be the same in both cases, and the watts per pound figure should always be higher for the diluted material.

Ferrite magnetic material is gaining widespread use in high frequency power conversion circuits and, in addition to its high permeability and high resistivity, has a unique property in that it can be machined or pressed into various geometrical shapes. Thus, unconventional means can be used to realize air gaps in power magnetics. The present invention is directed to improved low acoustic noise power inductive devices achieved by magnetic cores incorporating improved air gap configurations, and to such devices with low air gap fringing flux.

SUMMARY OF THE INVENTION

In accordance with the invention, ferrite magnetic cores in power inductive devices for use at high operating frequencies are made in various configurations such as two-legged, three-legged, and multi-legged structures, each providing a continuous path for magnetic flux including at least one radial magnetic air gap that is circumferentially uninterrupted and has a constant predetermined radial length for controlling the permeability of the core. To this end, one or more sections of the magnetic core in the region adjacent to the air gap includes a cylindrical element and a surrounding element with a circular opening in which the cylindrical element is retained so as to define therebetween the uninterrupted radial air gap of constant preselected length. Thus, the magnetic forces are radial in nature, and are balanced and substantially sum to zero to minimize movement and flexing in the core structure and thereby result in low acoustic noise.

In the preferred embodiment, the ferrite magnetic core structure is comprised by a rectangular outer member having aligned circular apertures into which extend the opposite ends of a cylindrical center member, thereby establishing radial air gaps at both ends or at one end each maintained by a non-magnetic spacer. The winding assembly is disposed about the center member. Optionally, the outer core member has a magnetic bridge for air gap fringing flux radiated to the outside. When magnetic bridges are provided for each air gap, the core is fabricated in two separable parts that are clamped together, and the core can also be made in a circular configuration similar to a cup core. Additional benefits of the foregoing air gap structure are that the pattern of fringing flux causes less heating of the windings and of external bands that may be employed for clamping.

In a second embodiment comprising two one-piece E-shaped parts that are clamped together, the center member is discontinuous and formed with a single radial air gap structure that is therefore completely surrounded by the winding assembly. The same radial air gap structure is also used in a two-legged core with two one-piece C-shaped parts that are clamped together. The several foregoing forms of the invention have many applications as low noise power inductors and transformers, including coasting inductors in high frequency chopper electronic ballasts, and commutating and filter reactors in power conversion circuitry.

BRIEF DESCRIPTION OF THE DRAWINGS

FIGS. 8 and 9 are front views of other modifications of the low acoustic noise magnetic core of FIG. 3 to reduce fringing flux in the vicinity of the air gaps;

FIG. 10 is a top view of a core structure as in FIG. 9 illustrating a two-part rectangular member with front and back halves rather than top and bottom halves as shown in FIG. 9;

FIG. 11 is a top view of a core structure of the type shown in FIGS. 8 and 9 constructed in a circular configuration similar to a cup core, FIG. 12 is a front view of a second embodiment of the inductive device and magnetic core structure structure in which the low acoustic noise and electrical noise air gap is in the center member surrounded by the winding assembly;

FIG. 13 is a front view partially in section of a power inductor built with a two-legged ferrite core having the radial air gap in one core section as shown in FIG. 12; and FIG. 14 is a modification of FIG. 13 illustrating a transformer for power circuits having air gaps in both core side sections.

DESCRIPTION OF THE PREFERRED EMBODIMENTS

Figure 1:
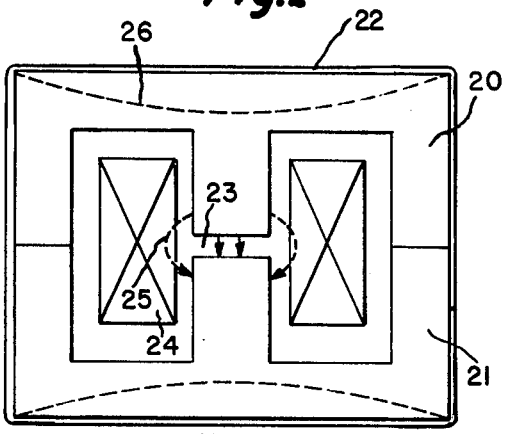
FIGS. 1 and 2 are front views, partly in diagrammatic form, of prior art power inductors or transformers respectively including an "E" core with an air gap in the center leg and a "C" core with air gaps in both legs.
Figure 2:
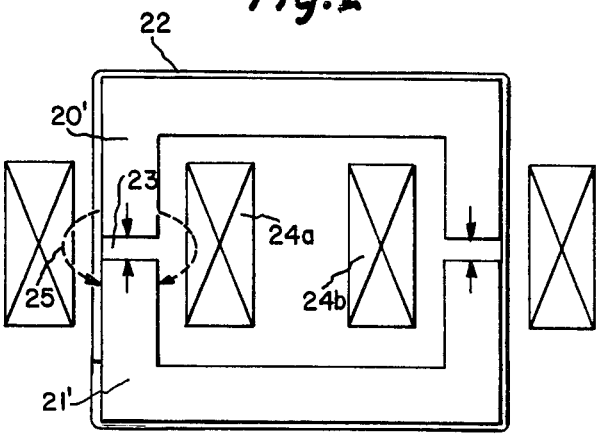
PRIOR ART Fig.2

The usual technique at present of introducing air gaps into power magnetics is shown in FIGS. 1 and 2. The power inductor in FIG. 1 is built with a pair of identical core halves 20 and 21 that are clamped together by external metal band 22 to form a conventional "E" magnetic core with a series air gap 23 in the center leg. The winding coil assembly 24, with or without a bobbin, is mounted about the center leg, and is linked by fringing flux at the air gap indicated by dashed arrows 25. During pulsating operation, magnetic forces proportional to the square of the magnetic induction B are developed which act across the air gap, as shown schematically by the solid arrows, and tend to periodically reduce the length of the air gap so as to minimize the energy in the air gap. Thus, movement and flexing of the core halves exist as is depicted at an exaggerated scale by the dashed lines 26, often resulting in the generation of considerable acoustic noise especially at high power. Also, as is more evident in FIG. 2, fringing flux 25 from the air gap can result in considerable heating of the windings in its vicinity as well as heating of the metallic band 22 which is used to clamp the core halves together. Moreover, the problem of eddy current losses associated with fringing fluxes is aggravated at high frequencies and it may be necessary to use more expensive clamping tape or fixtures. In FIG. 2, a transformer with windings 24*a* and 24*b* has a conventional "C" magnetic core with series air gaps 23 in the opposite legs established between identical core halves 20′ and 21′.

Figure 3:
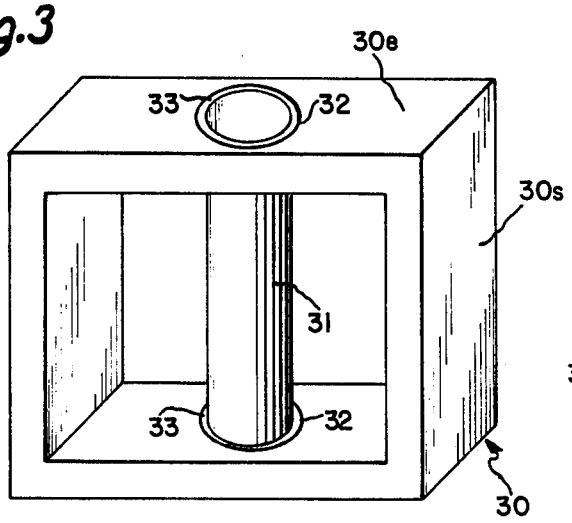
PRIOR ART Fig.3
FIG. 3 is an isometric view of a three-legged ferrite magnetic core according to the preferred embodiment of the invention incorporating an improved air gap arrangement to achieve low acoustic noise.
Figure 4:
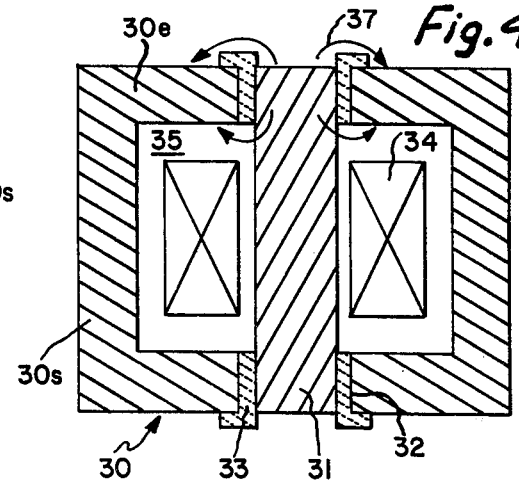
FIG. 4 is a vertical cross section through the magnetic core in FIG. 3 with the addition of a winding assembly on the center member to form a power inductor or transformer.

The ferrite magnetic core structure with an orthogonal or radial air gap for low acoustic noise is shown in FIG. 3 in its simplest form according to the preferred embodiment of the invention. This three-legged magnetic core is comprised by an essentially rectangular one-piece outer member 30 having opposing side sections 30*s* and end sections 30*e*, and by a cylindrical center member 31 that is continuous in the longitudinal direction. A pair of aligned circular apertures or openings 32 are machined into the two outer member end sections 30*e*, or alternatively the rectangular outer member is pressed into this shape. The opposite ends of cylindrical center member 31 respectively extend into aligned circular apertures 32 to thereby define at either end a radial magnetic air gap of constant predetermined length that is further circumferentially continuous and uninterrupted. A non-magnetic spacer 33 is mounted in the magnetic air gap space between each end section 30*e* and the respective end of center member 31 to maintain the radial air gap and support the center member. As is shown in FIG. 4, spacer 33 can be a nylon tube or washer with an outwardly directed lip at one end for ease of assembly into circular aperture 32 with center member 31. A winding assembly 34, wound directly on the center member or on a toothed split bobbin, is placed about the center member in the window areas 35 provided between outer and center members 30 and 31. If desired, spacer 33 at one end can be eliminated and a zero air gap provided at that end.

Figure 5:
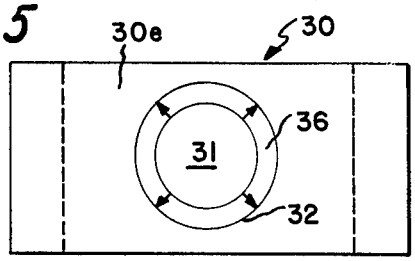
FIG. 5 is a top view of the magnetic core in FIG. 3 showing the balanced magnetic forces in the radial air gap.

In the top view of the magnetic core in FIG. 5, the circumferentially uninterrupted, radial magnetic air gap is designated by numeral 36. From magnetic circuit considerations the presence or absence of non-magnetic spacer material in the gap makes no difference, although centering and support of the center member are essential in this structure. The radial length of the air gap at all points around the circumference of center member 31 is substantially constant and selected to control the permeability and therefore the inductance of the magnetic core. As was mentioned, air gaps are needed to reduce the permeability of the core to keep it from saturating due to a dc component of current or high values of alternating currents. With this air gap geometry, the magnetic forces acting across the air gap (indicated by arrows) are radial and are balanced so as to substantially sum to zero. Since the radial air gap is circumferentially uninterrupted, there are no net forces tending to flex outer core member 30 or move cylindrical center member 31. Thus, movement of the core members is minimized and only a relatively small amount of acoustic noise is generated. Additionally, the magnetic core is mechanically strong without the need for external banding and clamping, and is relatively inexpensive and simple to fabricate.

Figure 6:
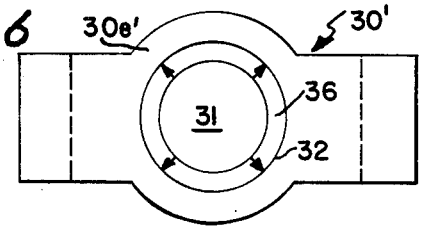
FIGS. 6 and 7 are top views of modifications of the core structure in FIGS. 3–5.
Figure 7:
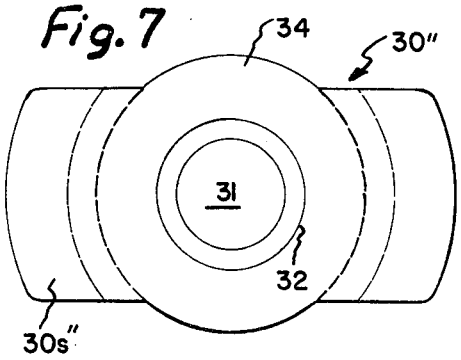

FIGS. 6 and 7 show modifications of the shape of the essentially rectangular outer core member that may be desirable for some applications. In FIG. 6, outer core member 30′ has modified end sections 30*e*′ with outwardly bowed arcuate central regions when it is desired that the diameter of center member 31 be comparable to the width of the major portion of outer core member 30′. In FIG. 7, modified rectangular core member 30″ has rounded opposing side sections 30*s*″ that are arcuate and conform to the curvature of winding 34 to make better use of the ferrite material. These core structures as well as the other unconventional core configurations to be described can be fabricated with relative ease inasmuch as the ferrite material can be pressed and machined into many different shapes. For optimum use of the ferrite material the cross-sectional area of the outer core member is one-half the cross-sectional area of cylindrical center member 31, since the magnetic flux in the center member divides equally between the two halves of the outer core member, however the cross-sectional area of the outer core member may be made somewhat larger when greater mechanical strength is desirable. Various simple and complex ferrites can be used in the practice of the invention, as is known in the art. As described by a leading manufacturer of ferrite materials, simple ferrites feature a spinel crystal structure, and in most cases conform to the formula $XFe_2O_4$, where X may be manganese, zinc, cobalt, nickel, or other metallic ion. Complex ferrites are actually a solid solution of two simple ferrites wherein X is a combination of two metallic ions in some fixed proportion, and typically are manganese-zinc or nickel-zinc ferrites. The most significant advantage of ferrite over laminated and powdered iron cores is its high resistivity, which affords a dense, homogeneous, magnetic medium, with high permeability, stable with respect to both temperature and time, but without the high eddy current losses inherent in conventional core materials.

It is noted that air gap fringing flux, indicated by arrows 37 in FIG. 4, exists outwardly of the magnetic core which may or may not be detrimental depending on the particular application. Electrical noise, i.e., fringing magnetic flux at the air gaps, may be radiated from air gaps with this geometry. Fringing flux is also present at the inner end of each air gap, however, this fringing flux causes no problem except that there may a small amount of heating if a corner of the winding is cut by the magnetic flux. As compared to conventional series air gaps of the types illustrated in FIGS. 1 and 2, however, there are reduced eddy current losses due to inner components of fringing flux. In the event that the outer components of fringing flux cannot be tolerated, then a magnetic bridge may be placed across the outside of the air gap and center member as shown in FIG. 8. In this modification, the magnetic bridge is present at only one end of outer core member 40, which is essentially rectangular and can be made in a one-piece construction similar to the rectangular outer core in FIG. 3. Accordingly, core end section 40*e* has an integral, outwardly projecting magnetic bridge 41 for air gap fringing flux, the central section of the bridge being spaced from the outer end of center member 31 by a longitudinally extending gap of length *d* that is substantially larger than the length l of the radial magnetic gap. A cup-shaped non-magnetic spacer 42 is inserted into the circular aperture before assembly of center member 31 to effectively fill both of these gaps. Spacer 33 for the radial air gap can have the same tubular shape as shown in FIG. 4. Inasmuch as the length of the longitudinal gap is much greater than the length of the radial air gap, the magnetic circuit in FIG. 8 is practically identical to the magnetic circuits in the core structures previously described. Any fringing flux at the outer end of the radial magnetic air gap is prevented from leaving the core since it is carried by bridge 41. Thus, center member 31 is completely enclosed within magnetic material at the one end, and is quiet from an electrical point of view at this end since there are no exposed air gaps. With reference to the prior art "E" and "C" cores in FIGS. 1 and 2, it will be observed that integral flux bridges carrying fringing magnetic flux are impossible in conventional series air gap cores since the bridge will connect the core on opposite sides of the air gap and simply saturate. By comparison, magnetic bridge 41 in FIG. 8 spans the entire circular aperture 32 and is connected only to magnetic material on one side of the radial air gap. Also, by allowing the bridge to protrude outwardly from the rectangular core member, all of the magnetic material in the outer core member is used effectively because it all carries flux. This would not be the case if circular aperture 32 was machined only partially through a core end section of rectangular cross section using unmachined material for the flux bridge. In that case, much material along the outer edge of the rectangular outer core member would not carry flux. An alternate construction is to eliminate spacer 33 and have a zero radial air gap so as to be electrically quiet at both ends.

FIG. 9 illustrates a modification in which the essentially rectangular outer core member incorporates magnetic bridges for air gap fringing flux at both ends of the core. In this case both ends of cylindrical center member 31 are completely enclosed and it is necessary to make the outer core member in two separable parts 43*a* and 43*b*. Both outer member end sections have an integral outwardly projecting magnetic bridge 41', each similar to the magnetic bridge in FIG. 8 except that the sloping corners save some ferrite material since very little flux is carried in the corners. The decision as to square or sloping corners is based on application considerations. Of course, non-magnetic spacers 42' at opposite ends of the center member then also have sloping corners. Upon assembly of the various components, including a pair of windings 34*a* and 34*b* to make a high frequency transformer, the two outer core parts 43*a* and 43*b* are clamped together such as by metal bands 44. These bands are not linked by any fringing flux so that there are no losses from this source. The core in FIG. 9 with magnetic bridges at both ends is quiet from both the mechanical point of view (no net force acting on the core members) and from the electrical point of view (no exposed air gaps).

Instead of being divided into top and bottom halves or parts, as shown in FIG. 9, the two-part rectangular outer member can be divided vertically into front and back halves 43*a'* and 43*b'* (see FIG. 10) that are clamped together by bands 44. The two different clamping directions are indicated in the figures. The small air gaps resulting from the joints are negligible compared to the main radial magnetic air gap and do not contribute significantly to acoustical or electrical noise when properly clamped. Note that banding is not a problem since bands 44 do not cross a significant air gap. Using cores with separable parts allows the ferrite pieces to be pressed in conventional fashion. FIG. 11 illustrates that other than rectangular or square magnetic cores may be used in the practice of the invention. For example, the core can be constructed in a circular configuration similar to a cup core. A hollow, circular outer core member 45 has a cylindrical wall section and connecting opposing end sections, and also the cylindrical center member 31 that is continuous in the longitudinal direction, and can be made without the magnetic bridges for air gap fringing flux or with a magnetic bridge 41'' at either one end or both ends. It is recognized that FIGS. 4, 8, and 9, assuming that FIGS. 8 and 9 are cross sections, are vertical cross-sectional views of these possible constructions. Of course, the magnetic cup core as here described is fabricated in two separable parts, such as the front and back halves 45*a* and 45*b*, each with a hemispherical cross section, as shown in FIG. 11.

A second basic embodiment of the main radial air gap structure and ferrite magnetic core is illustrated in FIG. 12 as applied to a three-legged core generally of the type previously described. In this embodiment, the circular center member is discontinuous and the radial air gap structure is placed in the center member so that it is completely surrounded by the windings. This decreases total leakage flux from the entire air gap for a rectangular core. In this case, the magnetic core is made in two one-piece generally E-shaped parts that are clamped together as by band 44. Thus, a rectangular outer member has two separable parts 46*a* and 46*b*, while the discontinuous center member is made in two pieces 47*a* and 47*b*, the opposite ends of which intersect the respective outer member end sections approximately orthogonally while the adjacent ends are configured to partially overlap in the longitudinal direction. To this end, the lower piece 47*b* has the same diameter throughout, while the upper piece 47*a* is mainly of the same diameter with the exception that the free end is cup-shaped and has a larger external diameter. With this configuration, there is established between the overlapping parts a main radial magnetic air gap of constant length *l* while the adjacent ends of the center member, similar to the arrangement shown in FIG. 8, are separated by a longitudinal gap of length *d* which is substantially larger than the radial air gap length. A non-magnetic spacer 48 maintains the spaced relationship between the two overlapping pieces of the discontinuous center member. The amount of air gap fringing flux is relatively small for this configuration and presents no problem as to external banding or as to undesired eddy current heating of the winding assembly 49.

FIGS. 13 and 14 show two-legged ferrite magnetic cores formed in two one-piece generally C-shaped parts that are clamped together, employing in one or both discontinuous side sections a modification of the radial air gap structure of FIG. 12. The two separable halves 50*a* and 50*b* of the rectangular core have opposing end sections and one butted together side section with either a circular or rectangular cross section, and the remaining discontinuous side section has a circular cross section with two different external diameters with the adjacent ends configured to partially overlap. In this case, the lower side section piece 50*s'* has a reduced diameter upper end which projects into the cup-shaped lower end of the upper side section piece 50*s* which now has the same external diameter throughout. A non-magnetic spacer 51 maintains the two side section pieces in spaced relation to define, as in FIG. 12, a longitudinal gap of length *d* that is substantially larger than the main radial magnetic air gap of length *l.* A single winding assembly 52 is disposed about the side section with the radial air gap structure to thereby form a power inductor device. Since the exposed air gap is internal, there is no undesired heating of the clamping band 44 that may be used to clamp the two parts together. The modification in FIG. 14 incorporates a rectangular core with the foregoing radial air gap structure included in both discontinuous core side sections. Winding coil assemblies 53*a* and 53*b* are disposed about each side section to thereby form a high frequency transformer. The two core halves or parts 50*a'* and 50*b'* can be fabricated with the cup-shaped structure on one part and the reduced diameter structure on the other part, but can be made identical halves by reversing the air gap structure in one side section so that the cup-shaped structure is on the lower part and the reduced diameter structure is on the upper part. Of course, the radial air gap structure of FIG. 12, which uses the magnetic material to a better advantage, can be used in the two-legged cores of FIGS. 13 or 14 and vice versa.

The introduction of circumferentially uninterrupted main radial air gaps into magnetic cores made of pressed homogeneous ferrite material has been discussed with regard to three-legged and also two-legged cores, but applies in principle to multi-legged cores as well. In any of these, the magnetic core comprises a plurality of sections which selectively intersect approximately at right angles to provide at least one window for receiving one or more winding assemblies. The core further provides a continuous path for magnetic flux including at least one radial magnetic air gap of constant predetermined length for controlling the permeability of the core. In terms of the air gap as more broadly defined, the sections of the core in the region adjacent to the radial gap include a cylindrical element and a completely surrounding element with a circular opening into which the cylindrical element extends. In such a main radial magnetic air gap, magnetic forces acting on the core sections are balanced and substantially summed to zero to result in low acoustic noise.

The invention has potential application in many magnetic components where low acoustic noise and electrical noise due to air gap fringing flux is desired. Typical applications as power inductive devices include power inductors and transformers for use at high operating frequencies in the range of about 5–50 kHz. By way of example, low acoustic noise power inductors as herein taught are particularly advantageous when utilized as the coasting inductor in a high frequency chopper electronic ballast for gaseous discharge lamps such as is described in U.S. Pat. Nos. 3,890,537 and 3,913,002, both assigned to the same assignee as this invention. Other exemplary applications are as commutating and filter reactors for power conversion circuitry.

While the invention has been particularly shown and described with reference to several preferred embodiments thereof, it will be understood by those skilled in the art various changes in form and details may be made therein without departing from the spirit and scope of the invention.

The invention claimed is:

1. A low acoustic noise power inductive device for high operating frequency power inductor and transformer applications comprising a ferrite magnetic core comprising an essentially rectangular outer member having opposing side sections and connecting end sections and further comprising a cylindrical center member that is continuous in the longitudinal direction, said core end sections having a pair of aligned circular apertures extending completely therethrough into which opposite ends of said cylindrical center member extend to define between at least one end section and the respective end of said center member a radial magnetic air gap of constant predetermined length for controlling the permeability of said core, and a non-magnetic spacer mounted between said one end section and the respective end of said center member to maintain the radial air gap and support said center member, whereby the magnetic forces acting on said core members are radial and substantially sum to zero to result in low acoustic noise, and a winding assembly disposed about said cylindrical center member.

2. A low acoustic noise power inductive device for high operating frequency power inductor and transformer applications comprising a ferrite magnetic core comprising an essentially rectangular outer member having opposing side sections and connecting end sections and further comprising a cylindrical center member that is continuous in the longitudinal direction, said core end sections having a pair of aligned circular apertures extending completely therethrough into which opposite ends of said cylindrical center member extend to define between at least one end section and the respective end of said center member a radial megnetic air gap of constant predetermined length for controlling the permeability of said core, and a non-magnetic spacer mounted between said one end section and the respective end of said center member to maintain the radial air gap and support said center member, whereby the magnetic forces acting on said core members are radial and substantially sum to zero to result in low acoustic noise, and a winding assembly disposed about said cylindrical center member.

* * * * *